United States Patent [19]

Stack

[11] 4,260,235

[45] Apr. 7, 1981

[54] CONTAMINATION PREVENTION SYSTEM

[75] Inventor: James B. Stack, Boulder, Colo.

[73] Assignee: International Business Machines Corporation, Armonk, N.Y.

[21] Appl. No.: 24,286

[22] Filed: Mar. 26, 1979

[51] Int. Cl.[3] ..... G03G 15/00; H01H 47/32; H01T 19/04; G03G 21/00

[52] U.S. Cl. ..... 355/3 CH; 15/300 R; 250/324; 355/15; 361/229

[58] Field of Search ..... 355/3 R, 3 CH, 14 CH, 355/15; 361/229, 230; 250/324, 325, 326; 15/1.5 R, 1.5 A, 300 R, 300 A

[56] References Cited

U.S. PATENT DOCUMENTS

| | | | |
|---|---|---|---|
| 3,239,863 | 3/1966 | Gardner | 15/1.5 R |
| 3,339,069 | 8/1967 | Hayne et al. | 250/326 |
| 3,382,360 | 5/1968 | Young et al. | 250/49.5 |
| 3,471,695 | 10/1969 | Hudson et al. | 361/230 |
| 3,615,813 | 10/1971 | Clarke et al. | 355/15 X |
| 3,702,417 | 11/1972 | Bower et al. | 361/230 |
| 3,741,157 | 6/1973 | Krause | 355/15 X |
| 3,936,184 | 2/1976 | Tanaka et al. | 355/15 |
| 4,014,065 | 3/1977 | Hudson | 355/15 X |
| 4,021,709 | 5/1977 | Kamogawa et al. | 361/229 |
| 4,026,701 | 5/1977 | Till et al. | 355/15 X |
| 4,165,171 | 8/1979 | Lemmen | 355/15 |

OTHER PUBLICATIONS

Rowe et al., "Vacuum Assist Pre-clean Corotron", Xerox Disclosure Journal; vol. 1, No. 6, Jun. 1976, p. 59.

*Primary Examiner*—Fred L. Braun
*Attorney, Agent, or Firm*—Charles E. Rohrer

[57] ABSTRACT

A system for minimizing contamination of an electrophotographic copier machine wherein toner particles and/or carrier beads are the contaminating agents. The leading edge of corona housings is positioned a substantial distance from the surface of a rotating drum so as to not affect the rotating boundary layer near the drum surface. In that manner, vortex formation within the corona housings may be prevented. The trailing edge of corona housings is given a curved shape and is at least as far removed from the drum surface as the leading edge. The system includes a vacuum scavenging chamber to remove toner particles entrained in the boundary layer. The leading edge of the scavenging chamber is given a curved shape to create a venturi in order to draw the boundary layer into the vacuum. Carrier beads are removed in the scavenging chamber since the broad curved leading edge interferes with fringe fields holding carrier beads to the surface. A positive preclean corona may be located within the scavenging chamber for further removal of carrier beads therein by neutralizing the photoreceptive charge and eliminating fringe fields. The trailing edge of the chamber is shaped as a knife edge.

38 Claims, 7 Drawing Figures

CONTAMINATION PREVENTION SYSTEM

This invention relates to electrophotographic copier machines and more particularly to the prevention of toner and carrier bead contamination of the machine components, particularly of the charge corona.

BACKGROUND OF THE INVENTION

In electrophotographic copier machines of the transfer type it is customary to utilize a support surface such as a rotating drum or a belt for mounting photoreceptive material upon which an image of the original document is produced. After producing the image it is developed and transferred to copy paper. The process requires the charging of the photoreceptive material to a relatively high voltage level, before exposing it to light rays reflected from the original document. The photoreceptive material is thereby discharged in an amount dependent upon the intensity of the light rays received and thereby caused to bear an electrostatic image of the original. Development is typically through the use of a black powdery substance called toner which is deposited on the undischarged portions in greater amount than the discharged portions. It is the black powdery toner which is transferred to copy paper causing the copy paper to bear an image of the original. Toner is then fused to the copy paper to produce a finished copy.

The uniform electrostatic charge placed upon the photoreceptor prior to exposing it to light rays reflected from the original is typically produced by a charge corona generator. The charge corona generator is comprised of the requisite number of emission wires raised to high voltage levels so as to ionize the air surrounding the emission wire and create a flow of charge to the photoreceptive surface. Such corona generators are well known in the art and are exemplified by U.S. Pat. No. 3,736,424.

The most popular developer mechanism in recent years has been the magnetic brush developer which is exemplified by U.S. Pat. No. 3,999,514. This type of developer is essentially comprised of a hollow rotating conductive shell surrounding permanent magnets inside the shell. The permanent magnets act to attract magnetizable materials to the surface of the rotating shell in order to carry the magnetizable materials from a reservoir to a development zone. In some cases the magnetizable material may be toner and in other cases it may be desirable to use small steel carrier beads which are coated with non-magnetic toner. In that manner the steel beads are attracted to the rotating shell by the permanent magnets within that shell and rotated on the surface of the shell from a reservoir to a development zone. At the development zone the toner is dislodged from the steel carrier beads and deposited upon the image of the original document. The steel carrier beads and the extra toner then fall from the development zone back into the reservoir.

The toner particles carry a natural electrostatic charge, i.e., a triboelectric charge, which may for example, be positive. The steel bead may be coated with a material such as "Teflon" which carries a negative triboelectric charge. Consequently, the positive toner is attracted to the negative carrier bead so that when the carrier bead is attracted magnetically to the surface of the magnetic brush roll, it is carried to the development zone. Through agitation at the development zone the toner is dislodged from the carrier bead and attracted to the surface of the photoreceptive material which, if the toner is positive, must be a highly negative surface. Thus, in the arrangement described, the charge corona must be a negative corona depositing a negative charge on the photoreceptive material. It should be noted that the charge structure can be reversed depending upon the type of photoreceptive material used, i.e., the charge corona could deposit a positive charge and the toner material could carry a negative triboelectric charge.

It has been found that despite the electrostatic attraction of toner particles to the oppositely-charged photoreceptive material, there is nevertheless a tendency for some of the toner particles to escape from the photoreceptive surface and move out into the body of the machine. It is believed that a major portion of toner contamination results from the transfer operation where toner particles are loosened and removed from the photoreceptive material and may not be captured on the surface of the copy paper. Much of that stray toner is captured and entrained in a boundary layer of air which rotates with the rotating photoreceptive material. While it is always unfortunate to contaminate machinery with a black, powdery carbon-like substance such as toner, it is particularly troublesome to create contamination of negative coronas. Suppose, for example, that a negative charge corona is being used. If positively-charged toner is deposited in the charge corona housing it is likely to strike the negative emission wire and contaminate that wire. In the course of time, deposits on the emission wires will create streaking on produced copies due to the formation of nodes or hot spots caused by the contamination. Even when positive charge coronas are used, negative preclean coronas must be used and a similar problem results within the preclean corona. Furthermore, it has been found that low pressure areas can exist within corona housings causing the formation of a vortex within the housing and a disturbance of the boundary layer bringing toner contamination into the corona. It is, therefore, a general object of this invention to reduce contamination within corona generators of an electrophotographic copier machine by reducing the amount of toner which may find its way into the corona housings.

In addition to toner contamination, occasionally a steel carrier bead will escape from the magnetic brush developer and be carried away on the photoreceptive surface. These stray steel beads are held on the rotating surface by "fringe fields" set up at the boundary of a highly charged area of the photoreceptor and an area which has been discharged. If anything interferes with the fringe field, the stray carrier bead is loosened from the photoreceptor and can escape into the machine. If these beads are swept into corona housings, corona arcing might occur. It is therefore a general object of this invention to remove stray carrier beads from the photoreceptive surface and deposit them in an area of little influence.

SUMMARY OF THE INVENTION

The inventor herein has recognized that toner contamination of coronas is due largely to the entrainment of toner particles within a boundary layer of air which moves with the photoreceptor and the removal of those toner particles from the boundary layer by the corona housing. Consequently, a scavenging chamber has been provided in order to remove toner from the boundary layer prior to reaching the corona housing. That is accomplished by providing a curved leading edge to the scavenging chamber in order to create a venturi relative to the boundary layer so that the boundary layer with its entrained toner particles is drawn into the scavenging chamber and removed therefrom through vacuum forces. The curved leading edge configuration of the scavenging chamber also has the effect of interfering with fringe fields holding stray carrier beads to the surface of the drum. This results in a loosening of stray carrier beads from the surface and causing them to be removed into the scavenging chamber.

Additionally, if a positive preclean corona is used, the inventor has recognized that it may be included within the scavenging chamber to neutralize photoreceptive charges in order to eliminate fringe fields. By eliminating fringe fields, stray beads drop off into the scavenging chamber and are collected in an area where they have little effect on corona performance. An important element of the invention is positioning the trailing edge of the scavenging chamber close to the drum surface to keep any carrier beads falling from the drum surface within the scavenging chamber and to peel away as much of the boundary layer as possible. However, when the trailing edge is placed close to the surface, it may interfere with remaining fringe fields and loosen carrier beads in the same manner utilized by the curved leading edge. Such loosening may cause stray carrier beads to be whirled from the photoreceptor outside of the scavenging chamber. To prevent this, the trailing edge is shaped to a knife-like edge to keep from interfering with remaining fringe fields and beads on the photoreceptor.

Another important element of the invention is to prevent the formation of vortexes within corona housings by placing the leading edge of the corona a sufficient distance from the drum surface so as to not interfere with the rotating boundary layer of air. Also, the trailing edge of the corona should be slightly further from the drum surface and given a curved shape. In that manner, the boundary layer will not be swept into the corona housing and there will be little interference with fringe fields.

BRIEF DESCRIPTION OF THE DRAWINGS

The above-mentioned and other features and objects of this invention and the manner of attaining them will become more apparent and the invention itself will best be understood by reference to the following description of embodiments of the invention taken in conjunction with the accompanying drawings, the description of which follows.

DETAILED DESCRIPTION

Figure 1:
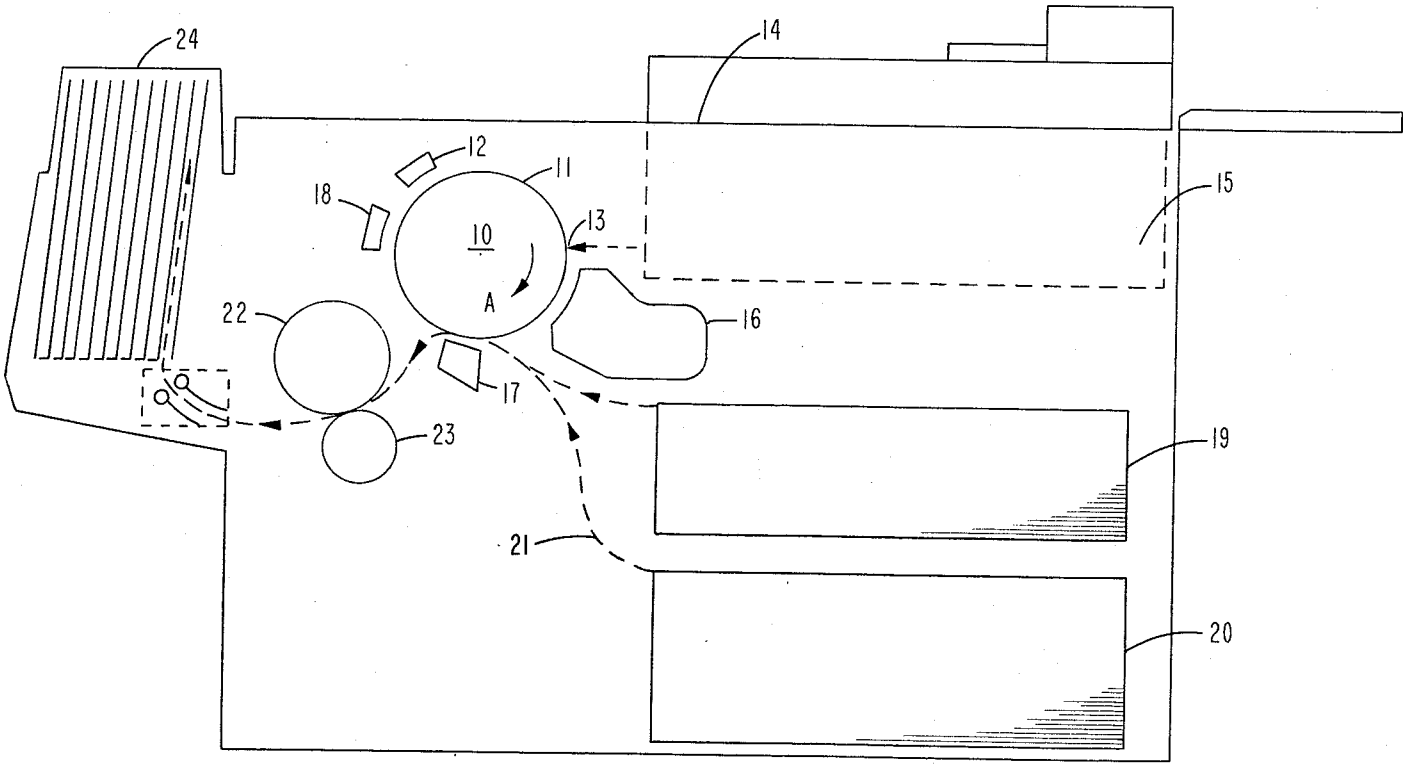
FIG. 1 shows the general layout of an electrophotographic copier machine of the transfer type.

FIG. 1 sets the environment for the invention and shows a typical electrophotographic machine of the transfer type. An electrophotographic drum 10 is shown with a photoreceptive surface 11 mounted thereon. A charge corona generator 12 generates an electrostatic charge which is placed uniformly across the surface of the photoreceptive material 11. As the drum rotates in the direction A the charged photoreceptive material is brought past an exposure station 13 at which an image of an original document is placed upon the photoreceptive surface. An original document is placed upon a glass platen 14 and imaged by optical mechanisms, not shown, located within an optical module 15.

Once the image has been placed upon the photoconductor it continues to rotate past the developing mechanism 16 where the image is developed by pouring toner upon the electrostatic image. As well known in the art, when the original document is imaged at exposure station 13, the white portions of the original document reflect a large amount of light, causing a substantial discharge of the photoreceptive surface 11. The black portions of the document, on the other hand, reflect small amounts of light, and therefore the photoreceptor retains most of the charge in these areas. Shades of coloring on the original document cause a discharging of the photoconductor to various degrees of voltage so that when toner is placed upon the image the high-voltage black areas retain large amounts of toner material, the colored areas less amounts, and the white portions will remain relatively free of toner.

After development, the drum 10 continues to rotate to bring the developed image to the vicinity of a transfer station where the image comes under the influence of a transfer corona generator 17. At that point a copy-receiving medium, usually copy paper, is juxtaposed against the rotating photoreceptive surface so that a charge may be placed by corona generator 17 upon the back side of the copy paper. Thereafter, the copy paper is stripped away from the photoreceptive surface and as it is stripped away, the charge on the paper acts to remove the toner from the photoreceptor, thus transferring the image from the photoreceptor to the copy paper. After transfer, the drum 10 continues to rotate so that the photoreceptive material is brought under the influence of a preclean corona 18 opposite in polarity to charge corona 12. The effect of corona 18 is to neutralize all remaining charge on the photoreceptive surface 11 so that any residual toner can be cleaned from the photoreceptor.

In the electrophotographic process shown in FIG. 1, which shows a machine with a two-cycle process, the drum continues to rotate past preclean corona 18 under the deenergized charge corona 12 to the developer mechanism 16 which now acts as a cleaner to clean the residual toner from the surface of the photoreceptor. The photoreceptive material continues to rotate until it once again reaches reenergized charge corona 12 and the process is repeated.

Copy-receiving material is stored in bins 19 and 20 and is removed by appropriate paper-feeding mechanisms to move copy paper along the copy paper path 21 to the transfer station, and after receiving the transferred image, on to a fusing mechanism shown by the fusing rolls 22 and 23. The fuser bonds the toner to the copy paper to form a permanent image of the original document thereon. Copy paper continues into a collator 24.

Figure 2:
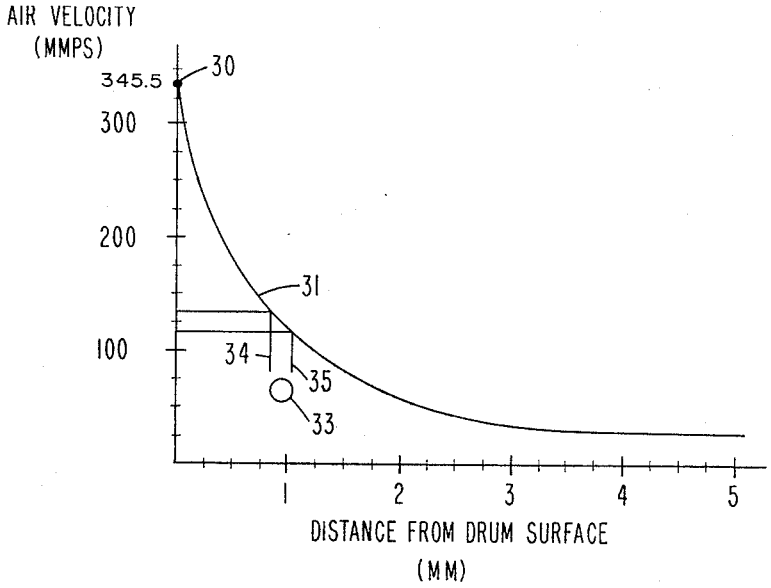
FIG. 2 is a graphical representation of the boundary layer flow profile.

In typical electrophotographic copier machines, such as the machine just described with reference to FIG. 1, the photoreceptive material is contained on a support surface such as drum 10 which rotates at rather rapid speeds. It is a well-known phenomenon that moving bodies tend to set up a boundary layer of air around the surface of the moving body such that this boundary layer of air tends to move at the same speed as the body itself. FIG. 2 illustrates the boundary layer flow profile found to exist around a rotating electrophotographic drum similar to drum 10 shown in FIG. 1. The particular peripheral velocity at which this drum was rotated to produce the curve shown in FIG. 2 was 345.5 mm per second. The layer of air next adjacent to the surface of the drum rotates at the speed of the drum as shown at point 30. Curve 31 shows that as the distance from the drum surface increases the velocity of the air rotating with the drum drops off to insignificant values. The inventor herein has recognized that the boundary layer of air depicted in FIG. 2 captures loose toner particles, especially near the transfer station, and eventually deposits them in corona housings and other areas of electrophotographic machines when the boundary layer is disturbed. Tests reveal that a significant amount of toner is entrained within the boundary layer of transfer-type machines.

Figure 3:
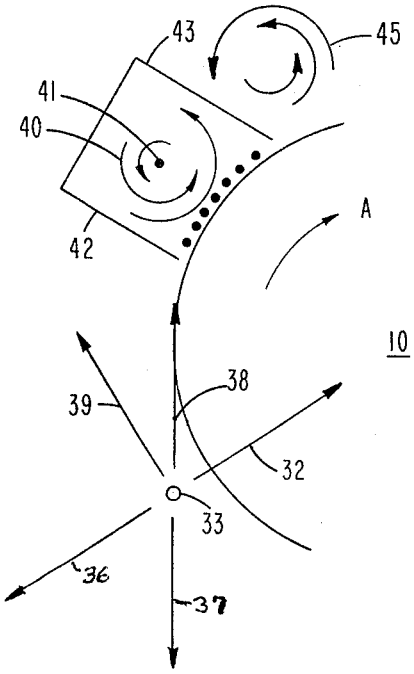
FIG. 3 is a force diagram of the various forces acting upon a toner particle entrained in the boundary layer.

FIG. 3 is a diagram of the forces which are present upon a toner particle entrained in the boundary layer. Force 32 is of particular interest since it is a force which holds the toner particle within the boundary layer. Force 32 is generated by the Bernoulli effect which can best be illustrated by referring again to FIG. 2. In FIG. 2 a toner particle, exaggerated in size, is shown at 33. Note that the surface of the toner particle closest to the drum surface is illustrated by line 34 which shows that an air velocity adjacent that surface is somewhat higher than the air velocity adjacent surface 35 which is the side of the particle farthest from the drum surface. As a consequence of this difference in velocities, a Bernoulli force 32 is created which tends to force the toner particle 33 toward the drum surface.

FIG. 3 illustrates the centrifugal force 36 which tends to pull the toner away from the boundary layer; force 37 which is the pull of gravity on the weight of the toner particle; force 38 which is the buoyancy of the toner particle in the fluid air; force 39 which is a combination of the viscous drag force of air flowing over the toner particle as it moves; and the velocity force which is the reacting force of air upon the leading surface of the toner particle as it moves through the air.

As can be seen from FIG. 3, if the force 32 created by the Bernoulli effect is sufficiently great, the toner particle will be entrained within the boundary layer. If the forces 36, 37 and 39 are sufficiently large to overcome force 32, the toner particle will spin away from the boundary layer and out into the machine where it is free to contaminate machine elements. Force 38 is negligible.

Contamination of coronas is an especially significant problem within electrophotographic copier machines since such contamination can result in serious quality defects on the copy product. It has been found that negative coronas are quite sensitive to toner contamination while positive coronas are relatively unaffected; consequently, where negative coronas are used, special attention to contamination prevention is desirable. The difference between negative and positive coronas in this respect is not fully understood.

Tests made on coronas show that there is a tendency for a vortex to form within a corona housing such as vortex 40 shown in FIG. 3. The formation of the vortex is due to the establishment of a low pressure area, generally in the area shown at 41, which causes part of the boundary layer to be swept into the corona housing, ultimately creating the whirling vortex 40. The effect of the vortex 40 is to disturb the boundary layer and sweep it into the corona housing where ultimately toner is deposited upon emission wires. The inventor herein has resolved the problem of vortex formation and resulting contamination of emission wires by preventing the formation of a vortex as shown by the configuration of the corona housing in FIG. 4.

Figure 4:
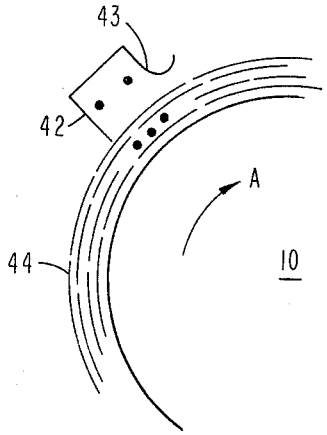
FIG. 4 shows a corona housing design to minimize the formation of a vortex within the housing.

Referring to FIG. 4, it may be noted that the leading edge 42 of the housing is positioned a sufficient distance from the surface of the drum, such that the boundary layer of air 44 passes beneath the edge 42 without being disturbed thereby. If the leading edge 42 were positioned close to the drum surface in the customary manner, the boundary layer would be disturbed and a vortex would be set up within the corona housing as explained above.

Note also that the trailing edge 43 of the corona housing has received a curvature so that any expansion of the boundary layer in a radial direction outwardly from the surface of the drum does not result in disturbances of the boundary layer since the curved surface tends to cause the boundary layer to move in a laminar fashion out of the corona housing area. Just as importantly, however, the curved surface of edge 43 prevents the formation of a low pressure area just beyond the trailing edge 43. In prior designs where the edge 43 extended in a sharp fashion into the boundary layer, such as shown in FIG. 3, a low pressure area 45 was formed which resulted in a portion of the boundary layer with toner moving into low pressure area 45 and eventually out into other parts of the machine. Thus, the design of the trailing edge 43 helps minimize the contamination of the corona and of the remainder of the machine while leading edge 42 tends to prevent contamination of the corona by preventing the formation of a vortex within the corona. It should be noted that the distance from the drum to that portion of trailing edge 43 closest to the drum should be greater than the distance from the drum to the leading edge 42. Experimentally, it has been determined that the effective boundary layer extends about 6 mm from the surface of the drum where the drum is moving at 345.5 mm per second. Therefore, the leading edge 42 of the corona should not be positioned closer to the surface of the drum than 6 mm and the trailing edge 43 should be slightly further away.

While the above described corona housing construction is important for preventing contamination of coronas, the basic problem of removing toner which has been entraped within the boundary layer of air is not yet solved.

Figure 5:
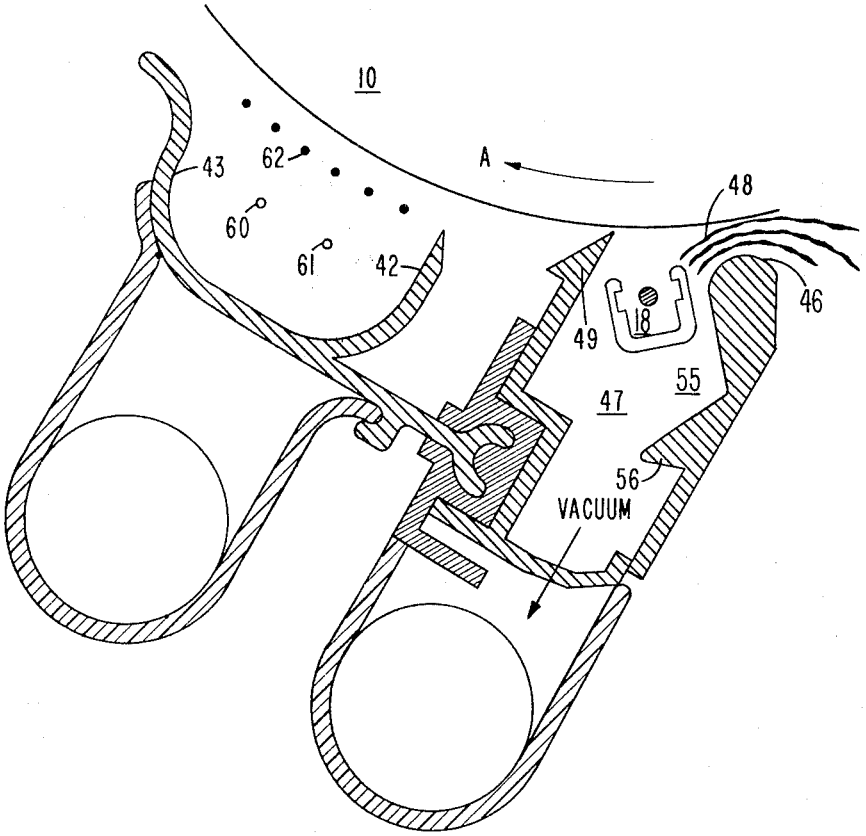
FIG. 5 is a view of the scavenging chamber of this invention with a preclean corona located therein.

The inventor herein has provided means for cleaning the boundary layer of air by preferably locating cleaning means shortly after the transfer station so that the large amount of toner entraped in the boundary layer after transfer can be cleaned away as soon as possible. The cleaning means used by the inventor is illustrated in FIG. 5 and is a vacuum scavenging chamber with means for drawing the boundary layer into the vacuum chamber 47. The latter means is comprised of a leading edge 46 of the scavenging chamber which takes a curved shape so as to form a venturi 48 between itself and the surface of the drum. The effect of venturi 48 is to create a laminar squeezing together of the boundary layer so that low pressure areas in front of leading edge 46 are not formed and toner-entrained particles in the boundary layer are retained therein until the boundary layer has passed through the venturi. Additionally, the well-known venturi effect once the boundary layer has passed the leading edge 46 causes an expansion of the boundary layer into the scavenging chamber 47, thus enabling the vacuum to remove air laden with toner particles. The trailing edge 49 of scavenging chamber 47 is located as close as possible to the surface of the rotating drum so that as much of the boundary layer as possible is peeled away from the surface of the drum. An internal baffle 56 may be used to restrict air flow in order to set up a more uniform flow profile lengthwise down chamber 47. Thus, there has been provided a scavenging chamber 47 such that the boundary layer with toner-entrained particles is removed.

Figure 6:
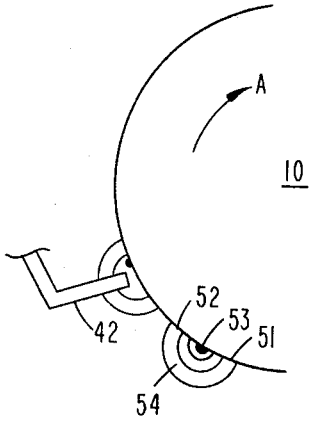
FIG. 6 is an illustration of fringe fields holding carrier beads to the surface of photoreceptive material.

While it is essential for good machine operation to prevent as much toner contamination as possible of the various machine components, it is also important to prevent the loss of carrier beads into the body of the machine. Unfortunately, there has been no successful design of a developer which completely retains all carrier beads within the developer; invariably, some small percentage of carrier beads is carried out of the developer on the surface of the photoreceptor. FIG. 6 illustrates carrier beads can be held on the surface of drum 10 by fringe electrostatic fields 54 which are established between unexposed areas of the photoconductor and exposed areas. In the unexposed areas of the photoconductor voltages may be extremely high, e.g., −800 volts, while in the exposed areas of the photoconductor, discharge has occurred which may produce voltages in the range of −150 volts. Consequently, an electrostatic field 54 is set up at the boundary of these two different voltage levels, and carrier beads can be captured within that fringe field and held to the surface of the drum thereby. In FIG. 6, for example, an unexposed area with a large negative charge is shown generally at 51, while an exposed area with a small negative charge is located at 52. A carrier bead 53 is shown nestled on the surface of the photoconductor held there under the influence of fringe field 54. Wall 42, which may be a corona wall, is illustrated as interfering with a fringe field.

Referring again to FIG. 1, the preclean corona 18 is a positive corona which neutralizes the negative charge on the photoconductor. Consequently, as the photoconductor rotates under preclean corona 18, both the large negative charge 51 and the small negative charge 52 are removed. The result is a removal of fringe field 54, causing carrier bead 53 to be whirled from the surface of the drum under the influence of centrifugal force and thus, after passing the preclean corona, carrier beads are lost into the machine where they create numerous problems. One problem, for example, is that they may be whirled into corona housings where they can build up and eventually cause arcing.

Referring again to FIG. 5, the inventor herein discovered that the leading edge 46 of the scavenging chamber can be positioned close enough to the drum and occupy a sufficiently long peripheral distance along the drum surface to act as a conductive plane and thereby interrupt the fringe fields, dislodging carrier beads and causing them to be whirled into the scavenging chamber 47. The trailing edge 49 is placed close to the surface of the drum in order to catch carrier beads which have been dislodged from the surface and cause them to bounce back into the scavenging chamber 47. In that manner carrier beads can be collected within the scavenging chamber, most likely in the hollow area 55, where they can be periodically removed by maintenance personnel.

The inventor also discovered that if one were to locate the preclean corona 18 within the scavenging chamber 47, the neutralizing effect of the preclean corona, together with the fringe field interrupting effect of the leading edge of the scavenging chamber 46, causes almost all of the carrier beads to be removed from the surface of the drum and whirled into scavenging chamber 47. It should be noted, however, that the preclean corona should be a positive corona if it is to be located within the scavenging chamber. If the particular electrophotographic process in use on a particular machine requires a negative preclean corona, then it should not be located within the scavenging chamber since it would become contaminated by toner.

The inventor also discovered that the trailing edge 49 is preferably shaped as a knife edge. The reason for this is that should any fringe fields remain with carrier beads held thereby, a wide trailing edge 49 might interfere with these fringe fields and loosen the carrier beads in the same manner as desired in the design of leading edge 46. Thus, a wide trailing edge 49 might cause the dislodgement of carrier beads, causing them to be whirled out into the machine or, in the case of the configuration shown in FIG. 5, into the charge corona. In order to prevent that, a knife edge should be used for the trailing edge 49 of the scavenging chamber so that these fringe fields are not disturbed and the carrier bead continues to rotate on the surface of the photoconductor.

It has been found that the leading edge 46 forming the venturi should not be located too close to the drum surface, for if it is, too strong a venturi effect will occur and toner may be removed from the surface of the photoconductor as well as from the boundary layer. For a machine in which the drum rotates at 345.5 mm per second, it has been found desirable to locate the leading edge of the scavenger at about 2.3 to 2.6 mm from the surface of the drum.

Figure 7:
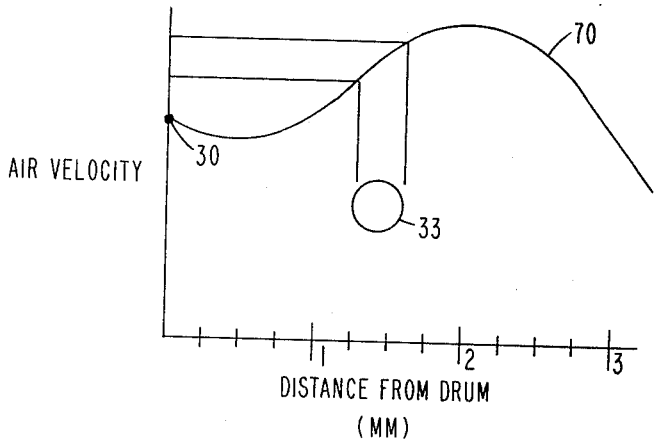
FIG. 7 is a graphical representation similar to FIG. 2, showing the effects of the venturi-type leading edge of the scavenging chamber.

Note also that in the embodiment shown in FIG. 5, a charge corona is located adjacent to the scavenger. Leading edge 42 of the charge corona is positioned a substantial distance from the drum surface and trailing edge 43 takes a convex shape and is also located a substantial distance from the drum surface. Emission wires 60 and 61 and grid wires 62 are shown. FIG. 7 is a graphical representation similar to FIG. 2 showing the effect of venturi 48 on the boundary layer 70 with measurements taken at a point on the drum surface just beyond the leading edge 46 within chamber 47. Because of the expanded boundary layer illustrated by FIG. 7, the Bernoulli force 32 previously holding particle 33 in the boundary layer is reversed, allowing toner particles to escape into chamber 47. Thus, there has been described a contamination prevention system which is designed to prevent vortex formation within corona housings, to remove toner from the boundary layer, and to remove stray carrier beads from the surface of the photoreceptor and deposit them in an area of little influence. The system developed to accomplish these objectives is comprised of a corona housing with the leading edge outside of the effective boundary layer and a trailing edge at least as far removed from the photoreceptor and given an equal shape; and a scavenging chamber with a leading edge configured to establish a venturi and a trailing edge located close to the drum surface and shaped as a knife edge.

While the invention has been particularly shown and described with reference to a preferred embodiment thereof, it will be understood by those skilled in the art that the foregoing and other changes in form and details may be made therein without departing from the spirit and scope of the invention.

What is claimed is:

1. An electrophotographic copier machine of the transfer type wherein a boundary layer of air moves with a moving photoreceptive material, comprising:

a support surface for said moving photoreceptive material;

charging means to deposit a relatively uniform charge on the photoreceptive material;

exposure means for producing an electrostatic image of an object to be copied on the charged photoreceptive material for variably discharging said material in accord with variations in the darkness of said object;

developing means for depositing toner particles on said electrostatic image;

transfer means to transfer said toner particles from said photoreceptive material to a copy-receiving medium; and a scavenging chamber located along the moving photoreceptor with a leading edge means positioned within said boundary layer, said leading edge means taking a curved shape to form a venturi with the photoreceptor surface to cause said boundary layer to expand into said scavenging chamber to minimize contamination of said machine by toner particles entrained in said boundary layer.

2. The machine of claim 1 wherein said scavenging chamber is connected to vacuum-producing means to draw said boundary layer and toner particles entrained therein out of circulation.

3. The machine of claim 1 wherein said scavenging chamber further includes trailing edge means positioned close to the surface of the photoreceptor to peel away as much of the boundary layer as possible into the scavenging chamber to minimize contamination of said machine by toner particles entrained in said boundary layer.

4. An electrophotographic copier machine of the transfer type wherein a boundary layer of air moves with a moving photoreceptive material, comprising:

a support surface for said moving photoreceptive material;

charging means to deposit a relatively uniform charge on the photoreceptive material;

exposure means for producing an electrostatic image of an object to be copied on the charged photoreceptive material for variably discharging said material in accord with variations in the darkness of said object;

developing means for depositing toner particles on said electrostatic image;

transfer means to transfer said toner particles from said photoreceptive material to a copy-receiving medium;

a scavenging chamber located along the moving photoreceptor with trailing edge means positioned close to the surface of the photoreceptor to peel away into the scavenging chamber as much as possible of said boundary layer to minimize contamination of said machine by toner particles entrained in said boundary layer.

5. The machine of claim 4 wherein said scavenging chamber is connected to vacuum-producing means to draw said boundary layer and toner particles entrained therein out of circulation.

6. An electrophotographic copier machine of the transfer type wherein a boundary layer of air moves with a moving photoreceptive material, comprising:

a support surface for said moving photoreceptive material;

charging means to deposit a relatively uniform charge on said photoreceptive material, said charging means comprising a corona generator including a housing therefor and wherein the leading edge means of the corona housing is positioned away from the surface of the photoreceptive material a distance sufficient to avoid disturbing said boundary layer and to avoid setting up a vortex within said corona housing to minimize contamination of said corona generator by toner particles entrained in said boundary layer;

exposure means for producing an electrostatic image of an object to be copied on the charged photoreceptive material for variably discharging said material in accord with variations in the darkness of said object;

developing means for depositing toner powder on said electrostatic image; and transfer means to transfer said toner from said photoreceptive material to a copy-receiving medium.

7. The machine of claim 6 wherein said corona generator further includes a corona housing trailing edge means with a curved shape, the closest part of said trailing edge means positioned at least as far from said photoreceptive material as said leading edge means, to avoid disturbing said boundary layer and to avoid setting up a low pressure area near said trailing edge means to minimize contamination of said machine by toner particles entrained in said boundary layer.

8. The machine of claim 6 further including a scavenging chamber located along the photoreceptive material with a trailing edge means positioned close to the surface of the photoreceptor to peel away into the scavenging chamber as much as possible of said boundary layer to minimize contamination of said machine by toner particles entrained in said boundary layer.

9. The machine of claim 8 wherein said scavenging chamber is connected to vacuum-producing means to draw said boundary layer and toner particles entrained therein out of circulation.

10. The machine of claim 9 further including a scavenging chamber leading edge means positioned within said boundary layer and taking a curved shape so as to form a venturi with the photoreceptor, to cause said boundary layer to expand into said scavenging chamber to minimize contamination of said machine by toner particles entrained in said boundary layer.

11. The machine of claim 7 further including a scavenging chamber located along the periphery of said surface with a trailing edge means positioned close to the photoreceptive material surface to peel away into the scavenging chamber as much as possible of said boundary layer to minimize contamination of said machine by toner particles entrained in said boundary layer.

12. The machine of claim 11 wherein said scavenging chamber is connected to vacuum-producing means to draw said boundary layer and toner particles entrained therein out of circulation.

13. The machine of claim 12 further including a scavenging chamber leading edge means positioned within said boundary layer and taking a curved shape so as to form a venturi with the photoreceptor, to cause said boundary layer to expand into said scavenging chamber to minimize contamination of said machine by toner particles entrained in said boundary layer.

14. An electrophotographic copier machine of the transfer type wherein a boundary layer of air rotates along the surface of a rotating drum, comprising:

a drum mounted for rotation;

photoreceptive material mounted on the surface of said drum;

charging means to deposit a relatively uniform charge on the photoreceptive material;

exposure means for producing an electrostatic image of an object to be copied on the charged photoreceptive material for variably discharging said material in accord with variations in the darkness of said object thereby producing electrostatic fields in the fringe areas where charged and discharged portions of said material are adjacent;

developing means for depositing toner particles on said electrostatic image, said toner particles carried to a development zone by carrier beads;

transfer means to transfer said toner particles from said photoreceptive material to a copy-receiving medium; and scavenging means located along the periphery of said drum for removing stray carrier beads held on the surface of said photoreceptive material by fringe electrostatic fields, wherein said scavenging means comprises conducting means for interfering with fringe electrostatic fields to thereby loosen said stray beads from said material and allow said stray beads to fall into said scavenging chamber.

15. The machine of claim 14 wherein said scavenging means includes a chamber into which said stray carrier beads are deposited upon removal from said photoreceptive material.

16. The machine of claim 15 wherein the scavenging chamber includes a trailing edge means positioned close to said drum surface for intercepting stray beads whirled from said drum and shaped as a knife edge to avoid interference with remaining fringe fields.

17. The machine of claim 16 wherein said conducting means comprises the leading edge means of said scavenging chamber positioned close to the surface of said drum over a substantial periphery thereof to interfere with fringe fields.

18. The machine of claim 17 in which a corona means is positioned within said scavenging chamber to eliminate fringe fields and thereby aid in the removal of said stray carrier beads into said chamber.

19. The machine of claim 17 wherein said leading edge means of said scavenging chamber is positioned within a boundary layer of air which rotates along the surface of said rotating drum, said leading edge means taking a curved shape to form a venturi with the drum surface, to cause said boundary layer to expand into said scavenging chamber to minimize contamination of said machine by toner particles entrained in said boundary layer.

20. The machine of claim 19 wherein said scavenging chamber is connected to vacuum-producing means to draw said boundary layer and toner particles entrained therein out of circulation.

21. The machine of claim 20 wherein said charging means comprises a corona generator including a housing therefor and wherein the leading edge means of the corona housing is positioned away from the drum surface a distance sufficient to avoid disturbing said boundary layer and to avoid setting up a vortex within said corona housing to minimize contamination of said corona generator by toner particles entrained in said boundary layer.

22. The machine of claim 21 wherein said corona generator further includes a corona housing trailing edge means with a curved shape, the closest part of said corona housing trailing edge means positioned at least as far from said drum as the corona housing leading edge, to avoid disturbing said boundary layer and to avoid setting up a low pressure area near said trailing edge means to minimize contamination of said machine by toner particles entrained in said boundary layer.

23. The machine of claim 22 in which a corona means is positioned within said scavenging chamber to eliminate fringe fields and aid in the removal of said stray carrier beads into said chamber.

24. The machine of claim 22 wherein said corona housing leading edge is positioned along the periphery of said drum adjacent to the trailing edge of said scavenging chamber.

25. The machine of claim 23 wherein said corona housing leading edge is positioned along the periphery of said drum adjacent to the trailing edge of said scavenging chamber.

26. Corona generator housing means located along a moving surface, comprising:

a leading edge means positioned away from said surface a distance sufficient to avoid disturbing a boundary layer of air moving with said surface and to avoid setting up a vortex within said corona housing to minimize contamination of said corona by said boundary layer.

27. The corona generator housing of claim 26 further including a trailing edge means with a convex shape, the closest part of said trailing edge means positioned at least as far from said surface as said leading edge to avoid disturbing said boundary layer and to avoid setting up a low pressure area near said trailing edge means.

28. A scavenging chamber for use with an electrophotographic copier machine of the transfer type, wherein toner powder is used for developing electrostatic images on a moving photoreceptive surface, and where a boundary layer of air moves with said surface, comprising:

a trailing edge means positioned close to the surface of the photoreceptive material to peel away into the scavenging chamber as much as possible of said boundary layer to minimize contamination of said machine by toner powder entrained in said boundary layer.

29. The scavenging chamber of claim 28 wherein said scavenging chamber is connected to vacuum-producing means to draw said boundary layer and toner particles entrained therein out of circulation.

30. The scavenging chamber of claim 29 further including a leading edge means positioned within said boundary layer and taking a curved shape to form a venturi with said moving surface to cause said boundary layer to expand into said scavenging chamber to minimize contamination of said machine by toner powder entrained in said boundary layer.

31. A scavenging chamber for use with an electrophotographic copier machine of the transfer type, wherein toner powder is used for developing electrostatic images on a moving photoreceptive surface, and where a boundary layer of air moves with said surface, comprising:

a leading edge means positioned within said boundary layer, said leading edge means taking a curved shape to form a venturi with the photoreceptive surface to cause said boundary layer to expand into said scavenging chamber to minimize contamination of said machine by toner powder entrained in said boundary layer.

32. The machine of claim 31 wherein said chamber is connected to vacuum-producing means to draw said boundary layer and toner particles entrained therein out of circulation.

33. A scavenging chamber for use with an electrophotographic copier machine wherein carrier beads are used to carry toner particles to a development zone for developing an electrostatic image on a moving photoreceptive surface and wherein fringe electrostatic fields are produced on said moving surface where discharged areas of said image and where stray carrier beads are held to said surface by said fringe fields comprising:

conducting means for interfering with fringe electrostatic fields tending to hold stray carrier beads to said surface to thereby loosen said stray beads from said surface and allow said stray beads to fall into said scavenging chamber.

34. The scavenging chamber of claim 33 wherein said chamber includes a trailing edge means positioned close to said surface for intercepting loosened stray beads and shaped as a knife edge to avoid interference with remaining fringe fields.

35. The scavenging chamber of claim 34 wherein said conducting means comprises the leading edge means of said scavenging chamber positioned close to said surface over a substantial portion thereof to interfere with fringe fields.

36. The scavenging chamber of claim 35 in which a corona means is positioned within said scavenging chamber to eliminate fringe fields and cause the removal of said stray carrier beads into said chamber.

37. The scavenging chamber of claim 35 wherein said leading edge means of said scavenging chamber is positioned within a boundary layer of air which moves along said surface, said leading edge means taking a curved shape to form a venturi with said surface to cause said boundary layer to expand into said scavenging chamber to minimize contamination of said machine by toner particles entrained in said boundary layer.

38. The scavenging chamber of claim 37 wherein said chamber is connected to vacuum-producing means to draw said boundary layer and toner particles entrained therein out of circulation.

* * * * *